US006922011B2

(12) United States Patent
Sluyterman

(10) Patent No.: US 6,922,011 B2
(45) Date of Patent: Jul. 26, 2005

(54) DEFLECTION SYSTEM FOR CATHODE RAY TUBES

(75) Inventor: Albertus Aemilius Seyno Sluyterman, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 123 days.

(21) Appl. No.: 10/140,502

(22) Filed: May 7, 2002

(65) Prior Publication Data

US 2002/0171352 A1 Nov. 21, 2002

(30) Foreign Application Priority Data

May 9, 2001 (EP) ..... 01201691

(51) Int. Cl.[7] ..... H01J 29/50
(52) U.S. Cl. ..... 313/412; 313/440; 313/413
(58) Field of Search ..... 313/440, 441

(56) References Cited

U.S. PATENT DOCUMENTS 3,914,641 A 10/1975 Standaart ..... 313/411
4,003,012 A * 1/1977 Chasens ..... 335/213
4,117,435 A * 9/1978 Hishida et al. ..... 335/270
4,197,487 A * 4/1980 Takenaka et al. ..... 315/370
4,396,897 A * 8/1983 Sluijterman et al. ..... 335/212
4,642,527 A * 2/1987 Takahashi et al. ..... 315/368.24
5,117,152 A * 5/1992 Duwaer et al. ..... 313/440
5,291,102 A 3/1994 Washburn ..... 315/383
5,512,802 A * 4/1996 Jamar ..... 315/368.25
5,565,732 A * 10/1996 Sluyterman et al. ..... 313/440
6,046,713 A 4/2000 Jamar ..... 345/13
2002/0130622 A1 * 9/2002 Chen et al. ..... 315/364

FOREIGN PATENT DOCUMENTS

GB 1454679 A 3/1976 ..... H01J/29/46

* cited by examiner

*Primary Examiner*—Mariceli Santiago

(57) ABSTRACT

The present invention relates to a display device comprising a cathode ray index tube (1) having a neck portion (1") and a screen portion (1). The display device comprises an electron gun assembly (3) for generating a plurality of electron beams (3R,3G,3B), positioned in the neck portion (1") of the cathode ray index tube (1), a deflection unit (5), placed around the neck portion (1") of the cathode ray index tube (1), for deflecting said plurality of electron beams (3R,3G,3B), and a convergence unit (6) for converging said plurality of electron beams (3R,3G,3B). The deflection unit (5) is placed at an axial distance from said electron gun assembly (3), closer to said screen portion (1'). The convergence unit (6) is placed in close proximity to the deflection unit (5).

16 Claims, 2 Drawing Sheets

DEFLECTION SYSTEM FOR CATHODE RAY TUBES

BACKGROUND AND SUMMARY

The present invention relates to a display device comprising a cathode ray index tube and also to a deflection system for use in a cathode ray index tube.

Many different display devices comprising cathode ray tubes are currently known. The most common type of cathode ray tube comprises a shadow mask, arranged on the inner side of the screen above a phosphor layer. The shadow mask has the function of shadowing two of the three phosphor areas when the third is being illuminated by an electron beam. Thus, when the "red" electron beam is activated, the shadow mask shadows the green and blue phosphor areas, etc. The shadow mask has several drawbacks, for example, it is costly and absorbs roughly 80% of the electrons emitted from the gun.

Consequently, cathode ray tubes have also been developed without shadow masks, sometimes referred to as beam indexing CRTs or intelligent tracking CRTs.

In such tubes, known from e.g. U.S. Pat. No. 3,914,641, the different phosphor areas are arranged in groups of strips, normally with a horizontal extension across the screen. The electron beams are deflected to land on the correct strips, commonly by means of a system of electrodes located adjacent and in between the phosphor strips. According to the most commonly used arrangement, two electrodes with elongate finger portions are arranged in such a way that each phosphor strip is located between finger portions belonging to different electrodes. Each electrode is arranged to detect a signal resulting from electron beams landing on the electrode, and the signals from the two electrodes are compared (e.g. subtracted or divided). The relationship between these signals is used to control the beam deflection unit in a feedback position control system.

Basically, there are two different categories of intelligent tracking CRTs, namely:

1) single beam systems, with only one electron gun, alternately illuminating phosphor strips of different colours, and 2) multi-beam systems, where several electron guns are employed, each illuminating one of the phosphor strip groups. The multi-beam systems of course have the advantage of writing red, blue and green information in one sweep.

The present invention is related to the latter category.

U.S. Pat. No. 3,914,641 discloses a multi-beam system having an electron gun assembly is arranged in the neck of a cathode ray tube. The electron gun assembly produces a multiple of, for example three electron beams, each intended to illuminate one of the above-described phosphor strip groups arranged on the inner side of the cathode ray tube screen. In order for each beam to hit the correct phosphor strip, the beams are vertically separated from each other as they hit the screen, i.e. provided with a so-called convergence error, in this case a vertical convergence error, because said strips are horizontally arranged. In order to deflect the beams to the correct spot on the screen, a deflection unit is arranged around the neck of the cathode ray tube, between the electron gun assembly and the screen. To provide said vertical convergence error, a quadrupole (such as a 90-degree quadrupole) is arranged around the neck of the cathode ray tube, close to the electron gun assembly.

A problem with this kind of display is, however, that it is difficult to maintain a constant vertical separation between the electron beams as they hit the screen, after they have been deflected. The reason for this is that the sensitivity of the quadrupole changes as a function of the deflection. This has usually the effect of a degraded picture quality around the edges of the display screen. One way to solve this problem is to operate the quadrupole with a dynamic signal taking the angle of deflection into consideration. This is, however, a somewhat complicated solution, especially since the amplitude of the dynamic signal tends to get large, and consequently there is a need for a simpler and more inexpensive way of attending to this problem.

Thus, it is an object of the present invention to provide a display device that overcomes the above-described problems with the prior-art device.

This and other objects are achieved by a display device comprising a cathode ray index tube having a neck portion and a screen portion, the display device comprising an electron gun assembly for generating a plurality of electron beams, positioned in the neck portion of the cathode ray index tube, a deflection unit, placed around the neck portion of the cathode ray index tube, for deflecting said plurality of electron beams, and a convergence unit for converging said plurality of electron beams, said deflection unit being placed at an axial distance from said electron gun assembly, closer to said screen portion, wherein said convergence unit is placed in close proximity to the deflection unit. Placing the convergence unit close to the deflection unit has the advantage that the uniformity (or effect as a function of the location on the screen) of the vertical beam variations varies with the axial position where the effect is created. The effect is virtually constant near the deflection centre of the deflection unit. Consequently, by placing the deflection unit and the convergence unit close together, a virtually constant vertical convergence error may be achieved. Furthermore, by placing the convergence unit close to the centre of deflection of the deflection field created by the deflection unit, one evades the above-mentioned problem that very large currents are needed, for CRTs with large deflection angles, in order to provide for a constant convergence error on the outskirts of the screen.

In accordance with a preferred embodiment, said convergence unit is placed at essentially the same axial distance from the electron gun assembly as the deflection unit. This embodiment further enhances the system. Moreover, the convergence unit may suitably comprise one or more windings wound around a yoke core in said deflection unit. By winding the windings of the convergence unit around the yoke core of the deflection unit, a very good centring of the deflection and convergence units is achieved. Moreover, a compact construction is obtained. Moreover, said convergence unit may comprise two or more windings wound around separated core parts of a split yoke in said deflection unit. By using two or more separated windings, which may be controlled separately, a very good uniformity can be obtained, resulting in a constant or virtually constant convergence error.

The above-mentioned and other objects are also achieved by a deflection system for use in cathode ray index tubes having a neck portion and a screen portion, the deflection system comprising a deflection unit, intended to be placed around the neck portion of the cathode ray index tube, for deflecting electron beams generated by an electron gun assembly in said index tube, and a convergence unit for converging said plurality of electron beams, wherein said convergence unit is placed in close proximity to the deflection unit. Placing the convergence unit close to the deflection unit has the advantage that the uniformity (or effect as a function of the location on the screen) of the vertical beam variations varies with the axial position where the effect is created. The effect is virtually constant near the deflection centre of the deflection unit. Consequently, by placing the deflection unit and the convergence unit close together, a virtually constant vertical convergence error may be achieved when said unit is used in a cathode ray index tube.

The convergence unit and the deflection unit are preferably positioned in such a way that their respective centre points essentially coincide. In doing so, the above-described effect of the correlation between the sensitivity of the quadrupole and the deflection is minimised. In accordance with a first embodiment of the invention, the convergence unit may comprise one or more windings wound around a yoke core in said deflection unit. By winding the windings of the convergence unit around the yoke core of the deflection unit, a very good centring of the deflection and convergence units is achieved. Moreover, a compact construction is obtained. In accordance with a second embodiment of the invention, said convergence unit may comprise two or more windings wound around separated core parts of a split yoke in said deflection unit. By using two or more separated windings, which may be controlled separately, a very good uniformity can be obtained, resulting in a constant or virtually constant convergence error.

BRIEF DESCRIPTION OF THE DRAWINGS

These and other aspects of the invention are apparent from and will be elucidated with reference to the embodiments described hereinafter.

In the drawings.

DETAILED DESCRIPTION

Figure 1:
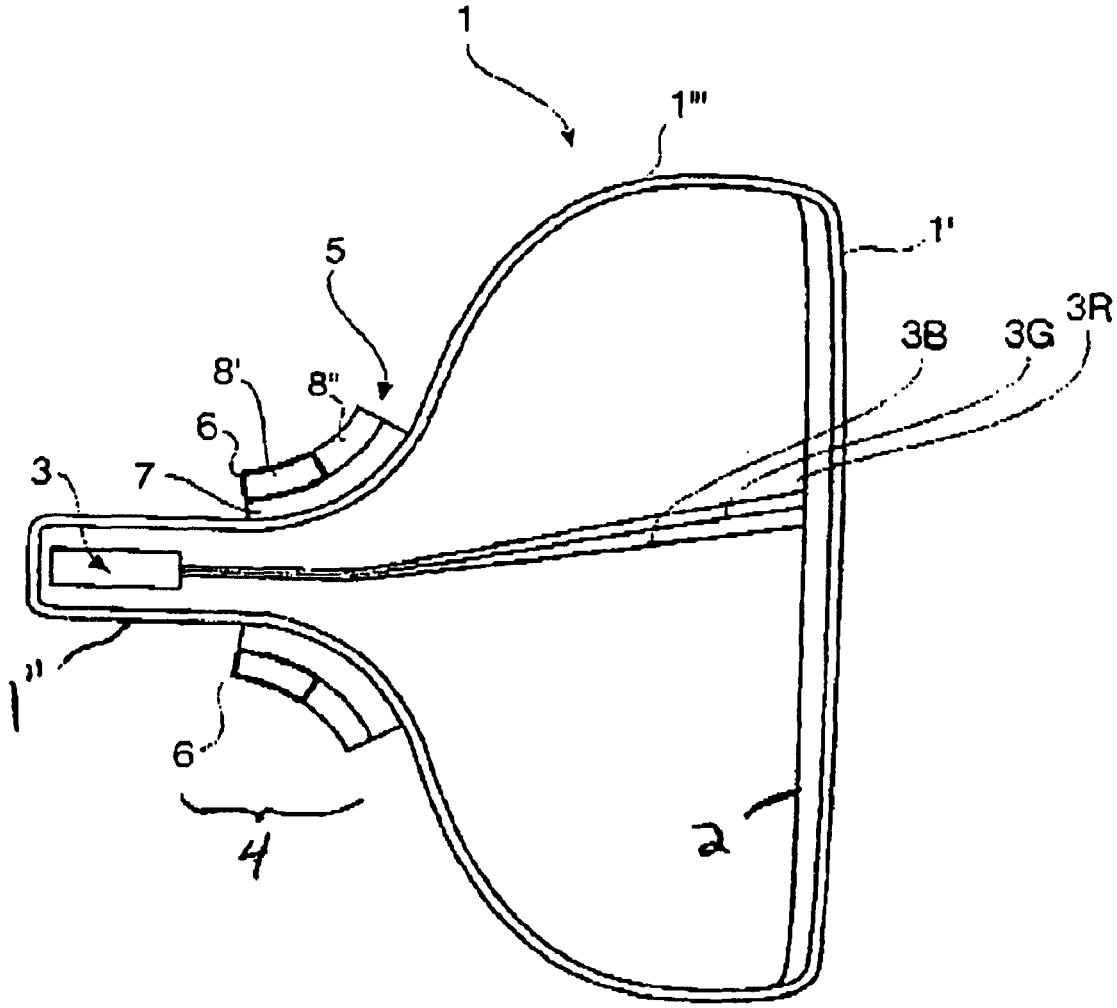
FIG. 1 is a schematic side view of a display device in accordance with the invention.

The colour display device in FIG. 1 comprises an evacuated cathode ray index tube 1 having a screen portion 1' and a neck portion 1" accommodating an electron gun assembly 3 for producing three electron beams 3R, 3G, 3B, preferably extending in one plane, in this case an essentially vertical plane. The screen portion 1' and the neck portion 1" are separated by a conical portion 1'" of the tube 1.

The direction of the beams 3R, 3G, 3B and the position of the electron gun assembly 3 are such that the middle electron beam 3G essentially coincides with the axis of the tube 1, when the beams are undeflected.

Said screen portion 1' is provided on its inner side with a phosphor layer 2 arranged in horizontal strips (not shown). The electron structure is not relevant to the invention and will therefore not be described in greater detail. In the present case, using a flat index tube, the phosphor layer is constituted by three groups of interspersed horizontal strips, adapted to luminesce in the colours red (R), blue (B) and green (G) respectively, when hit by electron beams 3R, 3B and 3G, respectively. The screen is provided with tracking sensors (not shown) in the form of two comb-shaped electrodes. Each electrode has a number of finger portions, which are arranged in an interdigitated fashion. Each phosphor strip is placed between two finger portions belonging to different electrodes. The electrodes can be formed on the screen by using e.g. lithography. As an example, only one pair of electrodes, covering the entire screen, may be used. However, the electrodes are not of great importance for the invention and will not be further described.

An electromagnetic deflection system 4 is arranged around the neck of the tube 1, between the electron gun assembly 3 and the screen portion 1' as shown in FIG. 1. Consequently, the beams that are generated in said electric gun assembly may be deflected by the deflection system 4 on their way to the screen portion, in which they hit a suitable phosphor strip and luminesce in red, green or blue, respectively.

The deflection system 4 comprises a deflection unit 5 for deflecting the three beams in two mutually perpendicular directions, in this case horizontally and vertically, to a respective spot on a corresponding phosphor strip. The deflection unit 5 comprises a number of deflection coils 7 for deflecting the beams 3R,3G,3B in known manner. A ring-shaped element 8, referred to as a yoke ring, is positioned around the deflection coils 7. The purpose of the yoke ring 8 is to reduce the magnetic flux lines outside the coils 7. The yoke ring 8 further comprises a first and a second core part 8', 8", the second part 8" being positioned closer to the screen 1' than the first part 8'. Together, the two parts 8',8" form a split yoke ring.

The deflection system also comprises a convergence unit 6 for bending the electron beams in relation to each other, i.e. towards each other or away from each other. The aim of the convergence unit 6 is to provide a constant vertical RB (red and blue, the outermost beams, respectively) convergence error, i.e. a constant vertical separation of the three beams as they hit the screen portion. The convergence unit 6 will hereinafter be described for three different embodiments of the invention. In all other aspects, the embodiments comprise the above-described elements, and these will therefore not be repeated.

Figure 2:
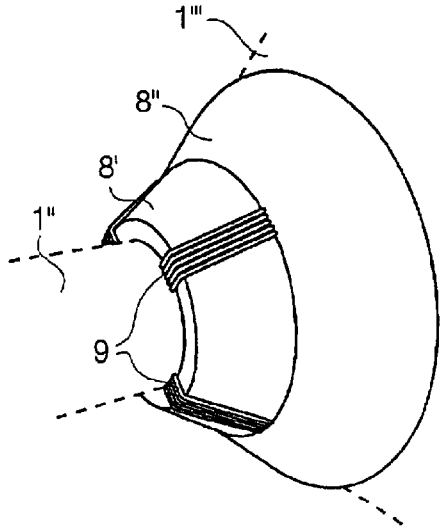
FIG. 2 shows a deflection system in accordance with a first embodiment of the invention.

According to a first embodiment of the invention, as shown in FIG. 2, the convergence unit 6 is integrated with the first yoke core part 8' of the deflection unit 5. In this case, the convergence unit 6 comprises four coils or windings, generally referred to as 9, wound around the first core part 8', together forming a 90-degree quadrupole. The windings are concentrated at the angles +/−45° and +/−135°, respectively. The windings are arranged to be fed by a DC current in order to generate a magnetic quadrupole field. By precise adjustment of the currents through the quadrupole, thereby adjusting and tuning the magnetic quadrupole field, a good uniformity can be obtained, resulting in a constant or virtually constant RB convergence error. The windings may have a plurality of forms, but the mode of winding as such is not important for the invention and will therefore not be further described.

Figure 3:
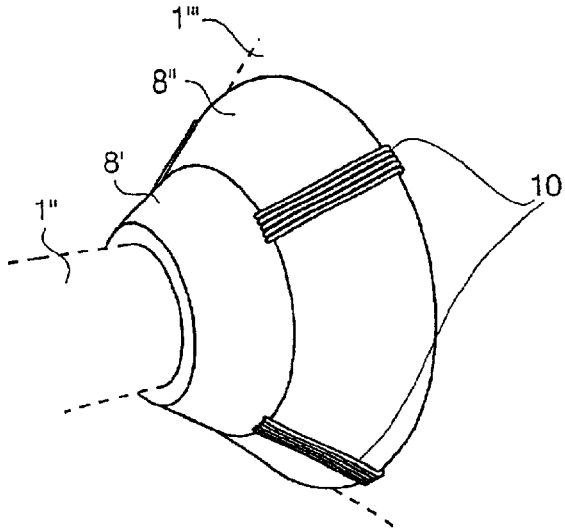
FIG. 3 shows a deflection system in accordance with a second embodiment of the invention.

In accordance with a second embodiment of the invention, as shown in FIG. 3, the convergence unit 6 is integrated with the second yoke core part 8" of the deflection unit 5. In this case, the convergence unit comprises four coils or windings, generally referred to as 10, wound around the second core part 8", together forming a 90-degree quadrupole. The windings 10 are concentrated at the angles +/−45° and +/−135°, respectively, as shown in FIG. 3. The windings are arranged to be fed by a DC current in order to generate a magnetic quadrupole field. By precise adjustment of the currents through the quadrupole, thereby adjusting and tuning the magnetic quadrupole field, a good uniformity can be obtained, resulting in a constant or virtually constant RB convergence error.

Figure 4:
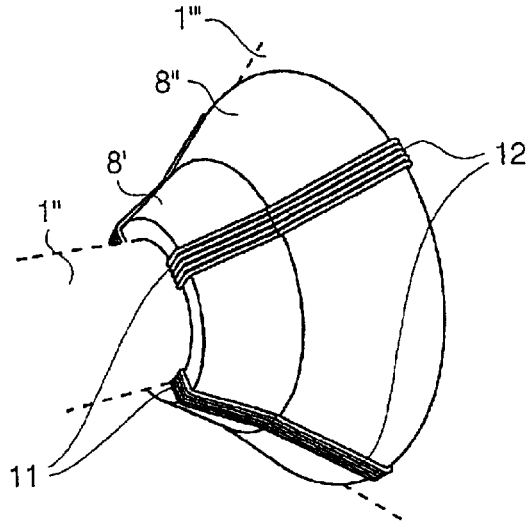
FIG. 4 shows a deflection system in accordance with a third embodiment of the invention.

In accordance with a third embodiment of the invention, as shown in FIG. 4, the convergence unit comprises two parts 11,12, the first 11 of which is integrated with the first yoke core part 8' of the deflection unit 5 as previously described for the first embodiment and the second 12 of which is integrated with the second yoke core part 8" of the deflection unit 5 as previously described for the second embodiment. The respective windings are arranged to be fed by a respective DC current in order to generate a combined magnetic quadrupole field. By precise adjustment of the currents through these two quadrupoles, thereby adjusting and tuning the combined magnetic quadrupole field, a very good uniformity can be obtained, resulting in a constant or virtually constant RB convergence error.

The present invention should not be considered as being limited to the above-described embodiment, but rather includes all possible variations covered by the scope of the appended claims. A person skilled in the art may arrive at alternative embodiments without departing from the scope of the appended claims, particularly if the windings have a plurality of shapes other than those shown in the appended drawings. They may have, for example, a saddle shape. In the present embodiment of the invention, as shown in FIG. 1, the three beams are essentially parallel to each other, as seen from the side, extending from the electron beam assembly 3 to the convergence unit. However, if seen from above, the beams in the present embodiment converge slightly in relation to each other on their way from the electron beam assembly to the defection unit, so that the beams are close to each other in the area of the deflection and convergence units. Moreover, the vertical separation between the beams is small in this area, so that the beams are really close to each other in the area of the deflection centre. After passing through the convergence and deflection units, the beams are diverged slightly from each other under the influence of the convergence unit, in order to provide for the desired convergence error as the beams hit the screen. This embodiment, having the beams close to each other in the area of the deflection centre, has the advantage that the current through the convergence correction coils may be maintained rather constant, without large deviations. However, it is also possible for the beams to have slightly diverging paths from the electron beam assembly to the convergence unit, whereafter the beams are converged slightly towards each other in order to provide for the desired convergence error as the beams hit the screen. Other beam paths are also possible. In accordance with an embodiment of the invention (not shown), the beams leave the gun assembly above each other (as seen from the side), and thereafter their beam paths cross each other vertically in the area of the deflection centre and then continue on their way to the screen where they then have the correct convergence value. Then the convergence unit only has to compensate for imperfections of the alignment, resulting in the current in the convergence unit being not only virtually constant, but also very small. It should also be noted that the angle the beams have in relation to each other as they leave the electron beam assembly is not of great importance for the broadest aspect of this invention, i.e. the positioning of the convergence and deflection units close together.

The yoke ring may comprise fewer or more parts, some or all of them having convergence coils in accordance with the examples described above. Even if the above-described embodiments show convergence units comprising coils that are wound around the yoke core of the deflection unit, it is possible to create a construction in which the convergence unit is a separate component, placed close to the deflection unit for minimising the deviation from a constant vertical convergence error. For example, the convergence unit may comprise coils wound around a separate ring-shaped element, which is not a part of said deflection yoke.

What is claimed is:

1. A display device comprising:

a cathode ray index tube having a neck portion and a screen portion:

an electron gun assembly for generating a plurality of electron beams, wherein said electron gun assembly is positioned in the neck portion of the cathode ray index tube;

a deflection unit, placed around the neck portion, for deflecting said plurality of electron beams; and a convergence unit for converging said plurality of electron beams;

wherein said convergence unit is coincident with the deflection unit.

2. A display device comprising:

a cathode ray index tube having a neck portion and a screen portion:

an electron gun assembly for generating a plurality of electron beams, wherein said electron gun assembly is positioned in the neck portion of the cathode ray index tube;

a deflection unit, placed around the neck portion, for deflecting said plurality of electron beams; and a convergence unit for converging said plurality of electron beams;

wherein said convergence unit is in close proximity to the deflection unit, and said convergence unit is placed at essentially the same axial distance from the electron gun assembly as the deflection unit.

3. A display device as claimed in claim 2, wherein the convergence unit comprises one or more windings wound around a yoke core in said deflection unit.

4. A display device as claimed in claim 2, wherein said convergence unit comprises two or more windings wound around separated core parts of a split yoke in said deflection unit.

5. A deflection system for use in a cathode ray index tube having a neck portion and a screen portion, the deflection system comprising:

a cathode ray index tube having a neck portion and a screen portion;

a deflection unit, intended to be placed around the neck portion of the cathode ray index tube, for deflecting electron beams generated by an electron gun assembly placed in the neck portion; and a convergence unit for converging said plurality of electron beams;

wherein said convergence unit and said deflection unit are formed integrally and said convergence unit is placed in close proximity to the deflection unit.

6. A deflection system as claimed in claim 5, wherein said convergence unit and said deflection unit are positioned in such a way that their respective centre points essentially coincide.

7. A deflection system as claimed in claim 5, wherein the convergence unit comprises one or more windings wound around a yoke core in said deflection unit.

8. A deflection system as claimed in claim 5, wherein said convergence unit comprises two or more windings wound around separated core parts of a split yoke in said deflection unit.

9. A display device, comprising:

a cathode ray index tube having a neck and a screen;

an electron gun positioned in the neck, said electron gun for generating a plurality of electron beams;

a deflection unit positioned around the neck portion, said deflection unit for deflecting said plurality of electron beams vertically and horizontally; and at least four convergence coils for generating a quadruple field for converging said plurality of electron beams, wherein said convergence coils are coincident with said deflection unit, and wherein said convergence coils are located at ±45° and at ±135° with respect to horizontal.

10. A display device as claimed in claim 9, wherein said convergence coils are wound around a deflection unit yoke core.

11. A display device as claimed in claim 10, wherein said convergence coils are wound around separated core parts of a deflection unit split yoke.

12. A display device as claimed in claim 9, wherein said deflection unit and said convergence coils are integrally formed.

13. A display device as claimed in claim 12, wherein said convergence coils and said deflection unit have coinciding center points.

14. A deflection system as claimed in claim 12, wherein said convergence coils are wound on a deflection unit yoke core.

15. A deflection system as claimed in claim 14, wherein said convergence coils are wound on separated core parts of a deflection unit split yoke.

16. A display device comprising:

a cathode ray index tube having a neck and a screen;

an electron gun positioned in the neck, said electron gun for generating a plurality of electron beams;

a deflection unit positioned around the neck portion, said deflection unit for deflecting said plurality of electron beams vertically and horizontally; and at least four convergence coils for generating a quadruple field for converging said plurality of electron beams, wherein said convergence coils are proximate said deflection unit, and wherein said convergence coils are located at ±45° and at ±135° with respect to horizontal, wherein said convergence coils are located at substantially the same axial distance from said electron gun as is said deflection unit.

* * * * *